US006598725B2

(12) United States Patent
Wilfong

(10) Patent No.: US 6,598,725 B2
(45) Date of Patent: Jul. 29, 2003

(54) COINSLIDE WITH MECHANICAL LATCH THAT PREVENTS RETRACTION WHEN DAMAGED

(75) Inventor: Evan C. Wilfong, Newark, DE (US)

(73) Assignee: Equipment Systems & Devices, Inc., Fort Washington, PA (US)

( * ) Notice: Subject to any disclaimer, the term of this patent is extended or adjusted under 35 U.S.C. 154(b) by 17 days.

(21) Appl. No.: 09/882,349

(22) Filed: Jun. 15, 2001

(65) Prior Publication Data

US 2003/0042110 A1 Mar. 6, 2003

(51) Int. Cl.[7] ..... G07F 9/02
(52) U.S. Cl. ..... 194/200
(58) Field of Search ..... 194/200, 201, 194/204, 234, 238

(56) References Cited

U.S. PATENT DOCUMENTS

| | | | | |
|---|---|---|---|---|
| 4,155,438 A | | 5/1979 | Greenwald | 194/4 |
| 4,197,932 A | * | 4/1980 | Mercurio | 194/238 |
| 4,350,240 A | | 9/1982 | Gitlin et al. | 194/92 |
| 4,401,202 A | | 8/1983 | Gitlin et al. | 194/55 |
| 4,499,983 A | | 2/1985 | Gitlin et al. | 194/1 |
| 4,502,584 A | | 3/1985 | Lambiris | 194/1 |
| 4,515,262 A | | 5/1985 | Wilfong et al. | 194/1 |
| 4,802,566 A | | 2/1989 | Wilfong et al. | 194/350 |
| 4,828,096 A | | 5/1989 | Gitlin et al. | 194/200 |
| 5,027,936 A | * | 7/1991 | Boyett | 194/238 |
| 5,074,396 A | | 12/1991 | Gitlin et al. | 194/200 |
| 5,220,988 A | | 6/1993 | Wilfong et al. | 194/235 |
| 5,303,808 A | | 4/1994 | Hiortdahl | 194/202 |
| 5,311,975 A | | 5/1994 | Hiortdahl | 194/235 |

* cited by examiner

*Primary Examiner*—Eileen D. Lillis
*Assistant Examiner*—Michael J. Kwon
(74) *Attorney, Agent, or Firm*—Duane Morris LLP

(57) ABSTRACT

A coin acceptor produces an output or operates a switch or vending mechanism when a coin acceptor slide reaches a certain point of advance relative to a housing. The slide receives coins or tokens tendered by a customer ("coins") and carries the coins into a discriminator responsive to size, shape or the like. The discriminator can have feeler levers, a limited passage size or similar features that permit the slide to advance if all the correct coins are present, or obstruct movement of the slide if coins are missing or are the wrong type. The discriminator is breakable with sufficient force, which could break away the feeler levers or other test structures the obstruct movement unless the correct coins are in place, which would permit the slide to be operated repeatedly without the correct coins. According to an inventive aspect, a latch mechanism engages if the slide is forced beyond its normal operating span, for example because it is forced, and locks the slide in an advanced position where it remains until serviced. The limit of the normal operating span can be defined by a frangible abutment that breaks away under moderate force. In any event, the slide locks in an advanced position and cannot be operated repeatedly without the correct coinage.

25 Claims, 4 Drawing Sheets

COINSLIDE WITH MECHANICAL LATCH THAT PREVENTS RETRACTION WHEN DAMAGED

BACKGROUND OF THE INVENTION

1. Field of the Invention

The invention relates to an improved coinslide or similar check operated device for tokens, coins or currency. The device mechanically locks to prevent retraction of the slide or operator after the operator has been forced, making it impossible to break the coinslide and then operate the associated appliance one or more times without authorization.

2. Prior Art

Vending applications typically require the customer to submit a predetermined amount of currency to make a sale. Often a particular number of specific coins or tokens are required, such as specific denominations of coins. Alternatively the device may accept alternatives and it may give back change. In a familiar vending machine type, a specific number of coins of specific denominations are placed by the customer in a coin acceptor apparatus that is wholly or partly mechanical. The coin acceptor is provided as a part of a vending machine or is appended to the vending machine in a way that is accessible to the customer for operation, accessible to a management or maintenance person who periodically removes collected coins, and is coupled to activate the vending machine when a sale is made. The parts used by the customer are as accessible as possible and the coin collection and the activation particulars are necessarily protected and secure.

The customer submits the required currency by placing coins in marked receptacles, and attempts to operate the vending machine. Typically, the successful operation of the coin acceptor moves a mechanical part and/or causes an electrical contact closure and/or generates a signal to activate the vending machine to vend a product or service, and at the same time removes the currency to a protected collection point. The collection point can be in the acceptor or in the vending machine. The acceptor and the receptacle used for collection preferably are suitably secured by stoutly constructed structural parts, locks and other such features. The coin acceptor is intended reliably to detect when the correct currency (e.g., a complement of several coins) has been tendered and to operate the vending device to vend the desired products or services only when a correct payment has been made. The acceptor also is intended to accumulate and to protect the currency tendered in successive vending transactions. However the effort and expense devoted to security are advantageously reasonably comparable to the amount at stake. That amount might be considered as the value of one vending operation, or the value of the total usage of the vending machine between service stops, etc.

In the case of a coin acceptor, the acceptor activates electrical switch contacts or a mechanical latch or toggle or other triggering event when the correct coins or tokens are submitted, and fails to activate or trigger in other situations. Coins of a given denomination can be counted. Coins have distinct dimensions (diameter, thickness and possibly shape or edge configuration) to identify their denominations. Coins may also be distinct as to their material, density, weight, color and/or other detectable aspects. Size, weight, density, ferromagnetic character, appearance and other characteristics can be sensed and used individually or in combinations distinguish among coins or tokens.

Coin acceptors and similar devices might be more or less sophisticated. It is possible automatically to make any number of physical measurements to discriminate among coins of different denominations and/or to distinguish between coins and slugs or coins of different countries. However, time consuming, expensive and inconvenient techniques may not be justified in given circumstances. The amount of each vending operation may be relatively small. Machines may be attended and watched or otherwise subjected to alternative security.

As a practical matter, coins can be effectively discriminated by their size. The most convenient and effective vending mechanism is often the well-known coinslide. A coinslide is typically a coin-size-responsive check-freed mechanism that is wholly mechanical (requires no electric power) and either permits a control in the form of a slide plate to be moved manually in a guide track or prevents such movement. When moved, the sliding plate ("the slide") or another part responsive to it, operates a control device and effects the vending operation. The slider can be moved when the correct coins are in place and not otherwise.

In a typical coin acceptor, a receptacle is provided with predetermined dimensions complementary to the expected coin size for each denomination. The receptacle may carry the coin along a constricted path as a slide is moved. The receptacle dimensions and the boundaries of the path both are specific to the expected size of the coin, and prevent "wrong" coins from advancing along the path with the slide to a detection point, or prevent a movable part of the device from being displaced as needed to operate the vending machine. In a coinslide arrangement for vending a washer or dryer cycle in a laundromat, or perhaps to release the balls to vend a game of pool, anywhere from two to seven coins might be called for, typically quarters, dimes and nickels.

Laundromat machines such as clothes washers and dryers are advantageously controlled using coinslides. Correct coins are needed to move a slide part of the coin acceptor to the end of its path, where an electrical or mechanical switch is located. The make-or-break contact action of the switch commences operation of the laundry device, which proceeds for one cycle of operation. The coins in the coinslide are removed and the slide is retracted such that a next vending operation requires a new complement of coins. Contact surfaces and toggling switches or other parts prevent the coinslide from being reciprocated only a short distance at the end of its stroke, which might operate the switch repeatedly. Also, there are techniques such as toggling mechanisms and the like that delay the coin drop or cause activation of the machine to await the operational point at which the coins have been collected. Some of these techniques can be defeated by breaking the mechanisms that keep the coinslide from being retracted into the starting position. This can be done in some mechanisms by using a crow bar, tire iron or other lever to pry at the end of the slide using a point on the casing as a fulcrum.

The typical laundromat coinslide is mounted on a coin collection box and protrudes from a point on the casing of a washer or dryer in an orientation where the coinslide is horizontal. Coin acceptors with similar coinslide structures also are used in devices other than laundry machines, such as games and in particular pay-to-play pool tables wherein balls dropping into the pockets are collected in a receptacle and a fee is paid to release the balls to commence a new game. The present invention is applicable to these vending situations and also to any other situation that is similarly operated by coins and a movable part such as a slide.

Coin slides as described can require one or two coins such as quarters, laid flat on the slide bar that is movable into a housing. For larger vending values, coin slides are known in which the coins are carried on edge. Coin receiving receptacles in coinslides have been made replaceable in a given slide to facilitate changing the amount to be charged for a vending operation. Exemplary coins slides are disclosed, for example, in U.S. Pat. Nos. 4,350,240; 4,401,202; 4,499,983; 4,515,262; 4,802,566; 4,828,096; 5,074,396; and 5,220,988, owned by the assignee of the present invention. Other examples can be found, for example, in U.S. Pat. Nos. 4,155,438; 4,502,584; 5,303,808; and 5,311,975. All these patents are hereby incorporated for their specific coinslide structures.

In a typical arrangement, several coins of the same or different denominations are placed on edge in close fitting coin receptacles. This is inherently selective because a larger diameter or thicker coin cannot fit into a receptacle that is dimensioned and shaped to complement a smaller coin. When the proper number of coins are in place, the customer manually pushes-in the slide. The slide carries the coins on a path such that each coin passes between the tines of teeth in a grill-like front plate. This can be closely dimensioned to select for thickness. The slide advances to the point where the coins are within a covered housing, making them inaccessible against being pulled back out of the acceptor. The receptacle for the coin in the slide, and the path of the coin leading into the housing, define a maximum coin width because a coin that is too large will not fit into the receptacle or move unobstructed along the path. A minimum coin width can likewise be discriminated, for example by providing a drop-through slot of minimum width.

Provided the proper coins are in place, the height of the top edge of each coin is known within a predetermined tolerance. A bridge bar is mounted in the housing and provides an abutment over the path of the coins. The bridge bar is high enough to permit correctly sized coins to pass under the bridge. A coin that is too large will jam against the bridge and prevent advance of the coin slide. The bridge determines maximum coin diameter, in conjunction with the coin receptacle in the slide.

A coin receptacle position might be occupied by a "wrong" coin that is smaller than the nominally correct coin, or a user may attempt to operate the slide without a required coin in place. A too-small coin or an empty coin position can pass under the bridge. A number of coin operated levers are provided to sense for coin size, especially to discriminate for minimum coin size and missing coins. These levers, which can be termed feeler levers or feelers, are positioned so that movable parts of the feeler mechanism bear against the coins and position other movable parts to form obstructions that prevent movement of the slide unless the levers rest against a coin of the nominally correct size at each coin position. When a nominally correct coin is in position, the associated feeler lever rests against the coin. This places the obstruction end of the feeler lever in a position to pass unobstructed as the slide is advanced. If the coin is too small (or absent) or optionally too large, the feeler lever obstruction end encounters an obstruction as the slide is advanced, which prevents the slide from moving forward far enough to effect a vending transaction. The feeler levers test for minimum coin diameter, and inherently, for the presence or absence of a coin. The obstruction end or portion of each feeler lever can bear endwise against the obstruction, of the feeler lever mechanism can define a hook or pawl that engages an obstructions to prevent advance of the slide beyond a certain point.

If the slide is advance such that the levers do not block the advance of the slide, and the coins fit without obstruction along the path, the slide can be advanced further, carrying the coins past the bridge and other detection aspects. During the advancing stroke during which the slide contacts the necessary electrical or mechanical switch to activate the vending apparatus, or optionally in the return stroke after such activation, the coins on the slide are removed and fall from the slide into a protected collection zone in the housing. In some embodiments, a latch arrangement prevents retraction of the slide until the slide has been manipulated fully to the point that the coins have been collected. In some embodiments there is a delay involved.

Acceptor coin slides of this general type are well known in a variety of specific arrangements. A slide can be configured permanently or changeably. It can be arranged to accept standing coins or coins that lay flat. It can have various different coin testing aspects such as feeler levers and bridges discussed above. It can be operated to test for correct coin loading and/or to activate a switch or mechanism and/or to remove and collect the coins, on the inward stroke or on the outward stroke or partly in each. It can have any of a number of specific dimensional sensing levers that bear against coins or against other items that bear against the coins.

Vending machines often are unattended and are generally susceptible to tampering and attempted theft of the collected coins. Coin slides that rely on mechanical aspects sometimes can be forced to operate without the nominally correct coins inserted. It may be possible with sufficient force, for example, to pass a coin slide under a bridge that is supposed to jam on too-high coins or on magnetically-lifted ferrous slugs (perhaps bending or damaging the coins or slugs or even breaking loose the bridge). It may be possible to force a coin slide to operate with coins that are smaller than nominal, or with no coins at all, by breaking or damaging the feeler levers that are movably mounted to block the slide in the case of too-small or missing coins. The coin slide might be forced to pass through a stroke that is supposed to be blocked by structures responsive to exceeding maximum size or not meeting minimum size requirements by damaging or breaking away the structures that are intended to block operation of the slide.

It is conceivably possible to make it more difficult to break coin-dimension-responsive feeler levers or bridge structures, by making such levers or structures of thicker and stronger material. This is not desirable because it is more expensive. It tends to reduce the accuracy of discrimination between coins. It makes the entire device more difficult for the customer to operate. And for most of the life of the coin slide, when the slide is being operated normally and honestly rather than being attacked, such measures are not necessary.

A coin slide might be forced to operate and broken, for example by hammering at the movable slide part with a club or weight. This could be done when there are no coins in place, or the attack can be concentrated by hammering on the slide when only one of the required coins is missing, thereby breaking the feeler levers for the coin positions one at a time. A feeler lever might be degraded rather than broken outright, perhaps by hammering on the slide when a slightly undersized coin is attempted. In any event, if the feeler levers or other blocking devices that are intended to obstruct slide operation become broken or bent to the point that they no longer produce an obstruction, there is nothing to prevent repeated reciprocation of the slide without ever inserting coins in the broken-feeler positions. In other words, by hammering at a slide until the movable mechanical stops (e.g., feeler levers) are broken or otherwise nonfunctional, the coin slide could be converted from a discriminating coin acceptor into an on/off switch. The vending machine is operable for free, until repaired. The users simply press the unobstructed slide inwardly to operate the switch or mechanism that activates the associated machine. This might be accomplished, for example, by beating the slide in the direction of operation, using a baseball bat, a length of two-by-four framing stud, a heavy pipe, or a similar relatively heavy clubbing tool.

The feeler levers, bridge and similar coin testing structures are internal to the coin slide housing, which is necessary to protect them from interference by a person attempting to cause the slide to operate without tendering all the proper coins, by manually positioning the feeler levers. As a result of the internal and protected placement of the feeler levers, there may be no external damage or other indication that distinguishes a broken coinslide in which the feeler levers have been broken off, from an intact coinslide. One cannot practically disassemble coinslides regularly to inspect for damage. A manager might indirectly detect a damaged coinslide based on a drop in the revenue collected by a vending machine. The manager might try all the coinslides in a facility to determine whether they operate correctly not, by attempting to operate them with at least one of the nominally required coins missing. This is obviously a less than convenient way to protect from vending losses.

It would be advantageous to disable a vending machine when its associated coinslide or acceptor is broken, so that it cannot be operated repeatedly while broken and thus limits the loss of revenue. Preferably, breaking of the coinslide feeler levers or other structures would somehow be externally apparent, so as to visibly distinguish a broken coinslide from an intact one.

The solution to this problem is not immediately apparent. Among other problems, there is nothing about operation of a damaged coinslide that is functionally different than operation of an undamaged one. The difference is that the damaged one advances and retracts without coins or with an improper complement of coins. An undamaged coinslide only moves freely with the proper coins in place, but both damaged and undamaged ones having in common that nothing prevents the coinslide from advancing to its operational position, activating the vending machine and retracting to its starting position for another stroke.

If repeated operation of broken coinslides could be prevented, coinslides reasonably could be made with more precise, lighter moving parts, even parts that could be more easily broken. The coinslides would be easier to operate, less expensive and more dependable. If the coinslides were made to break in a controlled way and dependable disable operation when broken, it might be possible to reduce the collateral damage that a person attempting to break a coinslide might do to the vending machine when beating on the coinslide to break it.

It is possible to envision a vending machine disabling apparatus in which improper operation prevents further operation of the vending machine. The machine might be disabled in the event of even minimum damage or even simply from excessive vibration that might be due to an impact. Such a device would function similar to the "tilt" switch that disables some gaming machines. That approach might facilitate disabling the vending machine but could be frustrating for potential customers who later attempted to operate the machine honestly.

SUMMARY OF THE INVENTION

It is an object of the invention to prevent the continued operation of a coinslide or similar coin or token operated device to vend products or services after the device has been damaged.

It is an object to lock a coinslide that has been forced to operate with improper coinage, so that the coinslide cannot repeatedly operate a vending apparatus or the like in a damaged condition.

It is another object to cause a moderate or even minimal attack on a device as described, to render the device visibly inoperable and disabled.

These and other objects are achieved by a coin acceptor of the type that produces an output or operates a switch or vending mechanism when a coin acceptor slide reaches a certain point of advance relative to a housing. The slide receives coins or tokens tendered by a customer ("coins") and carries the coins into a discriminator responsive to size, shape or the like. The discriminator can have feeler levers, a limited passage size or similar features that permit the slide to advance if all the correct coins are present, or obstruct movement of the slide if coins are missing or are the wrong type. The discriminator is breakable with sufficient force, which could break away the feeler levers or other test structures the obstruct movement unless the correct coins are in place, which would permit the slide to be operated repeatedly without the correct coins. According to an inventive aspect, a latch mechanism engages if the slide is forced beyond its normal operating span, for example because it is forced, and locks the slide in an advanced position where it remains until serviced. A frangible abutment that breaks away under moderate force can define the limit of the normal operating span. In any event, the slide locks in an advanced position and cannot be operated repeatedly without the correct coinage. Once the mechanism has been broken, it locks in a disabled position that is readily apparent to an observer. The locking employs a durable spring-loaded tenon that seats in a mortise that becomes aligned with the tenon only at a position beyond the normal operating span of the coinslide or similar acceptor. Under a moderate attack, the device locks in a manner that prevents further operation and the mechanism for locking is durable and inaccessibly placed so as to resist further attack even if the violence of the attack should be escalated.

BRIEF DESCRIPTION OF THE DRAWINGS

There are shown in the drawings certain embodiments of the invention as presently preferred. It should be understood that the invention is not limited to the precise arrangements and instrumentalities shown in the drawings, wherein the same reference numbers refer to the same parts in the respective views, and wherein.

DETAILED DESCRIPTION OF THE PREFERRED EMBODIMENTS

Figure 1:
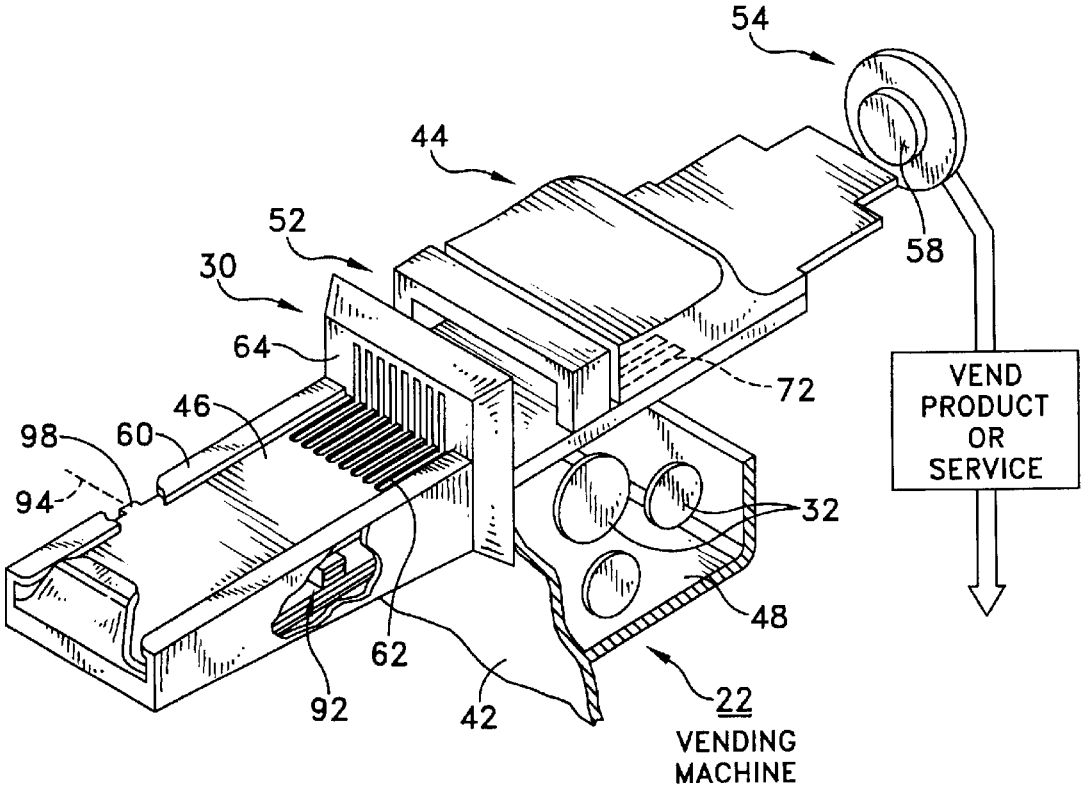
FIG. 1 is a perspective view, partly cut away, showing a coin or token acceptor according to the invention as installed in a vending or access control device.

An exemplary embodiment of the invention is shown in the drawings. The same reference numbers are used throughout the drawings to refer to like structures. In this description, terms suggesting spatial relationships and/or orientations are generally intended to describe the embodiment as exemplified in the examples and not to exclude other relationships or orientations that have the same structural nature and resulting operational characteristics.

Referring to FIG. 1, a vending machine 22 includes a vending control device 30 that operates to regulate vending of a product or service, or for permitting some form of access or the like. The control device 30 activates the machine 22 when one or more required tokens 32 is submitted. Otherwise, device 30 prevents activation of the machine 22 by protecting its actuation apparatus. The vending control device 30 can be associated with a laundromat washing machine or dryer, a pool table, an amusement ride or gateway, or any other such vending equipment or situation (not shown). The tokens 32 can be standard legal tender currency, typically in small denominations, such as dollar coins, half dollars, quarters, dimes and nickels. The tokens 32 might also be a special house-issued token of the type sometimes provided as gambling chips, transportation system access tokens or the like. The tokens 32 may comprise metal or another material and may be of any shape and size, not limited to familiar circular discs. To avoid repeating all these variants throughout this disclosure, any such currency, tokens and similar representations of value or authorization shall be deemed included by the term "coins."

The vending machine 22 or the vending/access control device 30 has a housing 42 that subdivides that unprotected outside from the working area and the coin collection area of a coin acceptor mechanism 44 that is mounted at the vending machine housing 42. The customer inserts the necessary coins 32 and attempts to operate the vending control device 30. The vending control device operates if the correct coins 32 have been tendered. If the correct coins have not been tendered, the coin acceptor mechanism 44 does not move freely and prevents the control device 30 from completing the mechanical stroke or the electrical or electromechanical or optical operation that effects the vending operation. In the example shown, the acceptor 44 comprises a manually reciprocated slide 46 that carries the coins 32 through the perimeter defined by the machine housing 42. The acceptor 44 could be rotary or otherwise movable in a similar way. In any event, the coins 32 are collected at a secure location such as a coin collection box 48 disposed inside the machine housing 42.

In a typical coin acceptor having a coinslide, for example of the type mentioned in the preceding discussion of the prior art and incorporated as part of this disclosure, the slide has mechanical or electrical devices that are responsive to whether or not the nominally correct coins 32 are found to be in place. Operation is prevented if such correct coins are not in place. If the correct coins are in place, the acceptor device 44 is free and along the reciprocating stroke of the slide 46, the slide or a part linked to the slide is caused to engage a switching device 54 such as a toggling mechanical mechanism or an electric switch or perhaps to interrupt an optical path. Such switching alternatives are exemplified in the embodiment shown in FIG. 1 by a pushbutton switch 58 that is encountered at or near the end of travel of the slide 46.

Coins 32 in the embodiment shown are placed vertically on edge at corresponding receptacles 62 in the slide 46. The receptacles can be permanent or can comprise replaceable fittings so as to change the denominations needed to operate the coin acceptor mechanism 44. As the slide 46 is manually advanced, the coins 32 pass through a front plate or bezel 64 of the acceptor, which can be comb-shaped to allow the coins 32 to pass on edge while obstructing access to the internal workings of the acceptor 44 by means of thin tools or attached strings or the like, that someone might attempt to pass along with the coins 32. The front plate or bezel 64 preferably is integrally cast as a unit or otherwise is durable coupled to the fixed housing parts of the acceptor 44. The fixed housing part 80 of the acceptor mechanism 44 defines a sliding track for the movable coin slide 46, while protecting the slide 46. In the embodiment shown, the acceptor housing 80 generally forms a channel that complements the cross sectional shape of the slide 46 and has flange edges extending laterally inwardly over the edges of the slide. The acceptor housing 80 and particularly the front plate 64, is fastened securely to the vending machine 22, for example by fasteners (not shown) that thread inaccessibly into the back side of the front plate 64 from within the vending machine 22. Inside the protective wall 42 of the vending machine, the acceptor mechanism 44 can have electrical, electromechanical, magnetic, mechanical, optical or other coin discriminating selection devices 52, generally represented in the drawings by a bridge 66 and by a housing containing feeler levers 72, which are best shown in the side elevation views of FIGS. 3 and 6.

The slide plate 46 of the acceptor holds the coins 32 and carries the coins forward into the discriminating part 52 of the acceptor at a nominal position. The slide plate 46 positions the coins 32 such that the upper edges of the coins are precisely at an elevation at which the coins will clear the bridge 66 if the coins are of the correct denominations. If one or more coins is larger than nominal, advance of the slide plate 46 is blocked because the over-large coin jams the slide against the bridge.

The slide plate 46 also positions the coins in conjunction with the feeler levers 72 (see also FIGS. 3 and 6), such that the feeler levers 72 sense for coins 32 of minimum size. The feeler levers rest against the coins 32 by spring bias or by gravity and are shaped and positioned so as to block the advance of the slide plate 46 if the coins 32 are too small (or are missing entirely) and thus fail to move the feeler levers to positions at which they are free of obstruction. The feeler levers 72 can be operable to obstruct movement endwise, or the levers 72 can be hook shaped and arranged to hook a portion of the slide 72 for obstructing it, unless correctly sized coins 32 lift the hooks of the levers away from an edge of the slide 46 that is otherwise engaged.

By sensing for maximum and minimum coin size, and potentially also by sensing for alternative or additional aspects such as the presence of ferrous material, the slide plate 46 is either blocked or is permitted to advance to the point at which the acceptor operates the vending machine 22, for example as represented by the bringing a contacting end of the acceptor 44 into sufficient contact with pushbutton 58 as shown in FIG. 1, to make and/or break electrical contacts or similarly to produce an output used for triggering operation. During advance or retraction of the slide plate 46 in this way, the coins 32 also are extracted from the coins slide plate 46, for example being caused to drop through the coin slide plate, and are collected in the coin collection box 48.

An acceptor 44 or its coinslide plate 46 as described might be forced by a vandal or a person seeking to obtain a vending operation without submitting the required coins. It is obviously disadvantageous from the operator's perspective to permit products or service to be vended without collecting the consideration that is asked. However apart from the loss of the value of the vending operation, there is a danger of undue damage to the coin acceptor equipment. The cost of repairing damage to the coinslide may be large compared to the value of a single vending operation. However depending on the consequences of damage (e.g., continuous free vending until the damage is discovered), the loss may be aggravated by the vending proceeds that are lost.

If a sufficient impact or force is applied to the slide plate 46, the acceptor mechanism could be broken. Although it might be possible to exert force with a lever or the like to pry a coin acceptor away from its mounting on a vending machine, that would also separate the moving parts of the mechanism, including the sliding coinslide plate 46, from the operational vending part, namely the switching device 54 in the embodiment shown. Thus, an attack on the coinslide mechanism is typically an attempt to force the coinslide plate inwardly toward the switching device 54 rather than to pull the coinslide plate outwardly.

If an attacker beats the coinslide plate inwardly to overcome the resistance produced by the coin discriminating or selecting devices 52, oversize coins might be bent or the bridge for blocking too-large coins might be deformed, to force the slide plate to advance with the wrong coin denominations or with slugs in place. If coins that art too small are inserted, or if no coins are in place, a sufficient force could bend or break the feeler levers 72 and allow the slide 46 to advance in the absence of coins or proper denomination coins. If these stopping aspects are broken, the slide 46 could be advanced to a position at which the slide plate engages whatever form of switching mechanism 54 is employed, to operate the vending machine. Moreover, if the discriminating mechanisms such as the bridge 66 and the feeler levers 72 are completely broken away, there is nothing to prevent the slide 46 from being reciprocated freely and repeatedly after the breakage occurs. In that case the acceptor 44 does not restrict access and the vending control device 30 permits access or deliver products or services without payment. Basically, the control device 30 is rendered into an activation switch.

According to the invention, this situation is prevented by providing the coin acceptor mechanism 44 with a pre-armed latching structure that becomes tripped by damage to the acceptor mechanism during an attack. When tripped, the latching structure fixes the coin slide or similar vending control device in a protective inoperative state from which it is not possible to operate the device, even though its normal structures for preventing operation might be wholly or partly broken away.

Accordingly, a vending control device 30 is provided for accepting coins or tokens 32 and producing an output useful in a vending transaction. The vending control device has an acceptor slide 46, movably mounted relative to a housing, which preferably is a housing 80 of the coin acceptor or vending control device, but could be a part of the vending machine 22 rather than part of the coin acceptor 44. The slide 46 is structured to receive the coins or tokens and to be movable toward an operating position at which the output is generated and has a path, for example a reciprocating path with an extreme inward sliding position 84, shown in FIG. 4. As described above, the vending control device 30 has a discriminator 52 in its housing, associated with the acceptor slide 46. The discriminator 52 has mechanisms such as a bridge 66, feeler levers 72 (FIGS. 3, 6) or other particular devices, and is operable to test for tender of a predetermined complement of coins or tokens 32. The discriminator 52 permits the acceptor slide 46 to move toward the end of its span, or its operating position for activating switching device 54, shown in FIG. 4, when the predetermined complement has been tendered and otherwise blocks the acceptor slide 46.

As discussed, the discriminator 52 is potentially breakable in a manner that defeats blockage of the acceptor slide 46 and permits the acceptor slide to pass the extreme inward sliding position 84. However according to an inventive aspect, a latch mechanism 92 is provided that seizes the slide 46 to its housing 80 if broken in that way. The latch mechanism 92 is operable to capture the acceptor slide 46 relative to the housing 80 when the acceptor slide 46 is forced along its path, beyond the extreme inward sliding position 84. In this way, the slide 46 is captured and rendered inoperable when the discriminator 52 is broken, as detected by the coinslide 46 being forced beyond its normal span. It is no longer possible after the slide is captured to generate the output.

According to another inventive aspect, the extreme of travel is defined by the abutment of surfaces 94, 96 of the slide and the housing, respectively, defining stops that meet at the extreme inward position of slide 46, at least one of which can be broken away or similarly overcome. The stop surfaces 94, 96 abut at or just ahead of the position at which the latch 92 operates to capture the slide 46. The structures on one or both of the slide 46 and the housing 80 that defines the stop can be displaceable with moderate force, and provides a structure that is preferentially compliant when force is applied. That is, the stop is displaced (e.g., moved, bent or broken away) and allows the slide to be captured by the latch. The stop structure can be arranged to permit the slide to pass (e.g., to break away or otherwise release) at a less extreme force and before the slide reaches a position at which other structures such as the feeler levers 72 might be broken.

Figure 2:
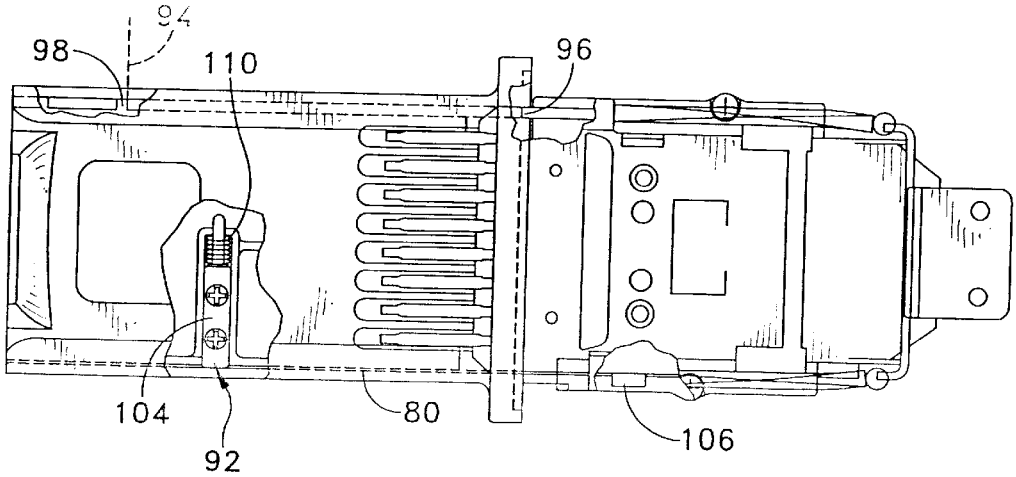
FIG. 2 is a top plan view of the acceptor of FIG. 1, also partly cut-away.

The stop in the preferred embodiment shown in FIGS. 1 and 2 is defined in part by a lateral extension or nub 98 of the slide, whose inward facing edge surface 94 abuts against a corresponding outward facing laterally extending surface 96 of the housing 80 when the slide is advanced. The surfaces of the lateral extensions of the slide and the housing abut at a position defining the extreme inward sliding position. Alternatively, the abutment of these surfaces can occur at a point slightly beyond the usual range of sliding. In any event, such point is only reached when other parts are broken or deformed. The operation of latch 92 occurs beyond the stop position, that is, beyond the usual or nominal un-damaged range.

In FIGS. 1 and 2, the extension 98 comprises a small tab that is frangibly attached to the slide 46 and is broken off by contact with a leading face 96 of the housing 80 along the sliding path of slide 46. The extension tab 98 shears off against face 96 when the slide is forced beyond the extreme inward sliding position. The stops can also operate in the opposite sense. That is, in an alternative embodiment (not shown), the extension can be a part of the housing that is sheared off by contact with a leading face of the slide, instead of vice versa as shown. It is also possible to have a plurality of similar extensions or frangible parts that break preferentially as part of the process of seizing the movable parts and disabling the coin acceptor.

The latch mechanism 92 according to the invention is subject to various specific embodiments. In the embodiment shown, the latch mechanism 92 comprises a laterally movable latch member or tenon 104 that is urged laterally outwardly from slide 46 toward a mortise or receptacle 106 by a spring 110, in a direction substantially perpendicular to the sliding direction. The latch member tenon 104 engages with the mortise 106 in housing 80 when the slide is beyond the extreme inward sliding position, and the engagement prevents movement of the slide in one direction. In particular, the latch prevents the slide from being retracted or pulled back so as to begin another reciprocating stroke of the slide 46. In this way, the broken slide can accomplish no more than one vending operation if activation of the switch is needed for each activation. No vending operation is possible upon locking the slide if each triggering requires operation of a switch followed by its release. In connection with a pushbutton or similar activation device as shown, edge triggered operation, or a relay arrangement that operates based on a sequence of on and off states, accomplishes this result.

In the preferred embodiment shown, the housing 80 defines a mortise 106 and the latch mechanism 92 comprises a spring biased movable tenon 104 carried by the slide 46. The tenon 104 engages the mortise 106 by moving laterally relative to the path of the slide 46, and the tenon 104 and mortise 106 are positioned so that they are aligned only when the slide has advanced beyond its normal position. The bias of spring 110 bears constantly against tenon 104, so all that is required for engagement is that the tenon become aligned with the mortise, thereby capturing the slide at a beyond-nominally advanced position of the slide relative to the housing.

The tenon 104 as shown has an inclined edge in the leading or inward direction to facilitate sliding over a potential obstruction or narrowing of the slide path (not shown) in a forward direction. Opposite from the inclined edge, the tenon has a relatively rectangular edge that abuts directly against the complementary lateral outer-facing side of the mortise 106 for positive locking in that direction.

The latch mechanism comprises a spring loaded latch member that can be carried in a lateral sliding receptacle 118 molded into the slide and having walls that enclose around the tenon in the direction of sliding and on the side opposite from the direction of sliding, thereby forming a laterally extending channel for the tenon 104. At the back or laterally inward end of the channel, a compression spring 110 such as a helical spring urges the tenon 104 in the direction of the mortise 106. The tenon falls into the mortise by spring pressure and remains in the mortise, preventing retraction of the slide, until the unit is serviced. The service may require disassembly of the slide from the housing by accessing the acceptor device from the side normally on the inside of the vending machine housing.

Figure 3:
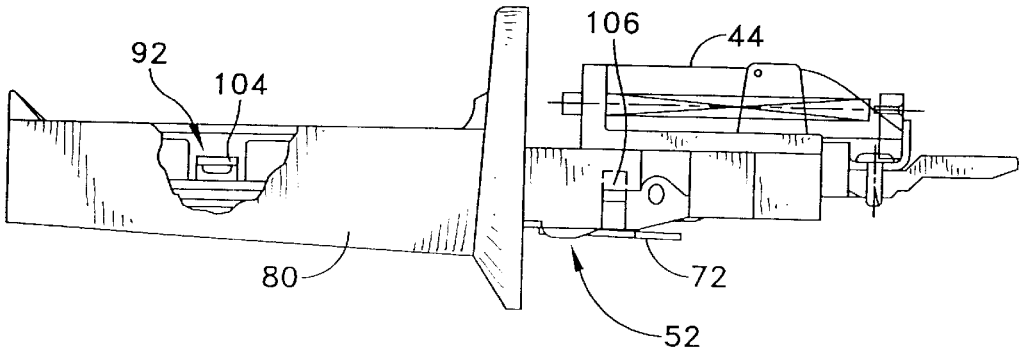
FIG. 3 is a side elevation view of the acceptor shown in FIG. 2.

In the depicted arrangement, the housing 80 defines a mortise and the latch member 104 engages the mortise 106 by moving laterally relative to the path, thereby capturing the slide at an advance position relative to the housing. FIGS. 2 and 3 show the normal rest position of the slide (i.e., retracted and awaiting a customer). The frangible stop protrusion 98 is in place. The capture tenon 104 is spring-loaded but remains in its laterally extending channel 118 along the slide 46. Preferably, the channel 118 and the tenon 104 are disposed on the underside of the slide 46 as shown in FIG. 3 and thus are protected from interference. The housing 80 of the acceptor defines a channel for the slide 46, i.e., enclosing around the sides and bottom of the slide and defining the slide path. The latch channel 118 and the tenon 104 or similar latch member is disposed substantially between an underside of the slide 46 and an inside bottom of the channel defined by the housing 80. Thus the latch member (e.g., the tenon) is armed during normal operation and is well enclosed, protected and confined.

In the embodiment shown, the tenon 104 is mounted on the slide 46 and is biased by the spring 110 toward the mortise 106 in the housing 80 of the acceptor. It is similarly possible to place the tenon 104 in the housing part for engagement with a mortise 106 in the slide 46, that is, to reverse the gender of the components as shown.

Figure 4:
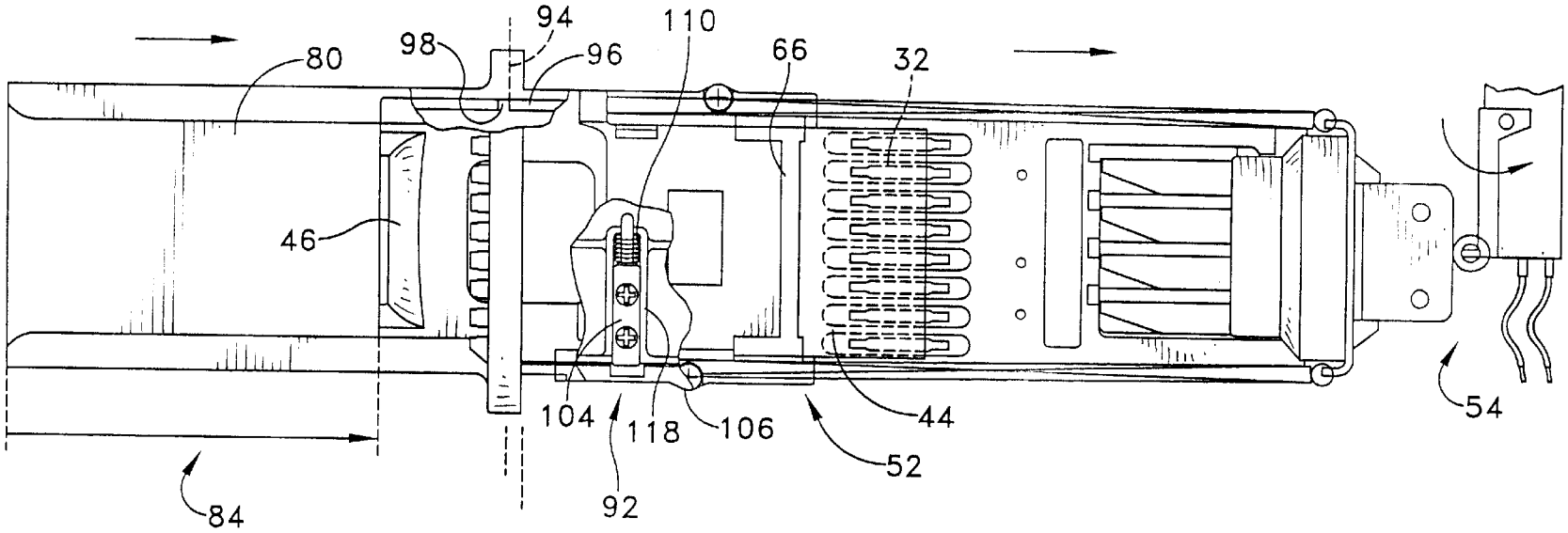
FIG. 4 is a top plan view corresponding to FIG. 2, but showing the coinslide of the acceptor at the extreme of its normal operating span, again partly cut-away.

FIG. 4 also demonstrates normal operation. The slide has been loaded with coins 32 and advanced to operate the movable part of a switch 54. FIG. 4 shows the fully advanced position of the slide at which the stop associated with the slide 46, which in this embodiment is defined by a frangible laterally protruding tab 98, is advanced up to and against a stop associated with the housing, which is an abutment defined by the end of a portion of the slide track for the slide 46.

It is not possible to move the slide shown in the drawings from the position shown in FIG. 2 to the position shown in FIG. 4, except by either tendering the required coins, or breaking the mechanisms that detect when the appropriate coins are present. It might be possible to force the coinslide to advance and to break the coin detection mechanisms, without moving the slide so far that the stop is broken and the slide moves beyond its normal range of operation. That could defeat the invention, but is virtually impossible to achieve. In order to break the coin detection mechanisms it is necessary to exert a not-insubstantial force. For example, the perpetrator might strike the end of the slide plate 46 with a hammer, mallet, two-by-four, baseball bat or the like, in order to break through the coin detection mechanisms. This force is generally more than sufficient to break away the frangible stop 98, which is a square projection only a few millimeters on a side (approximately 2.5 mm in the embodiment shown). The stop does not break in normal operation but shears away readily if a force is exerted that is likely to be sufficient to affect the coin detection mechanism.

Figure 5:
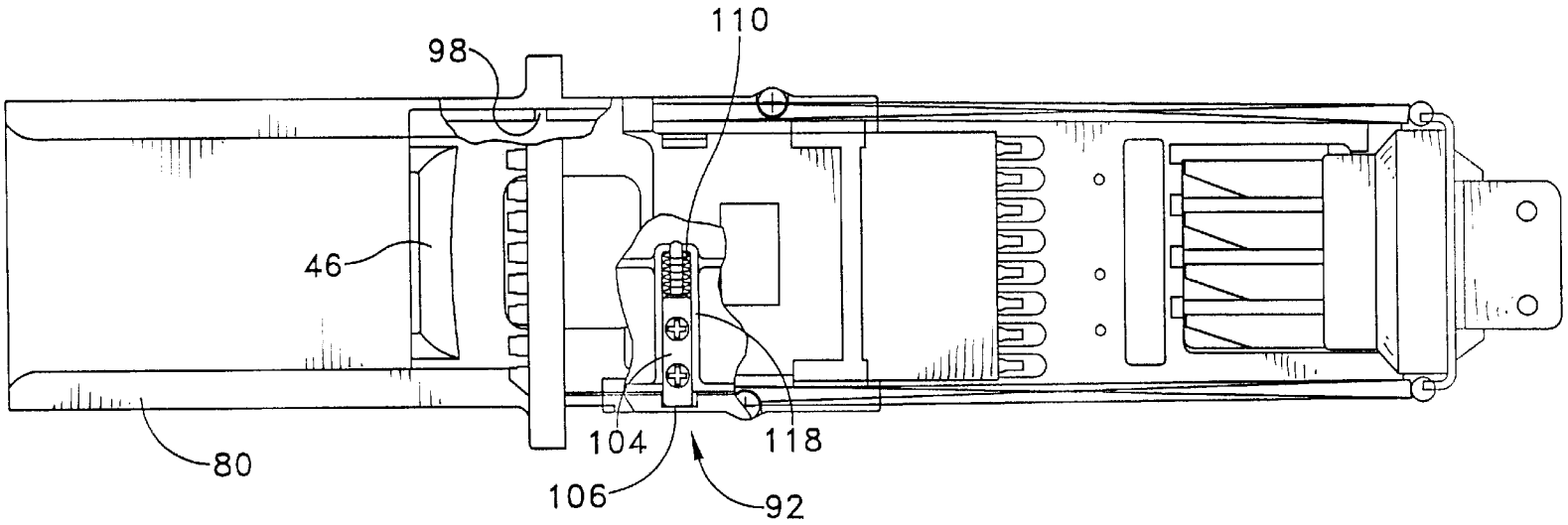
FIG. 5 is a top plan view, partly cut-away, showing the coinslide as forced to a position beyond its normal operating span and now locked against retraction or further use.
Figure 6:
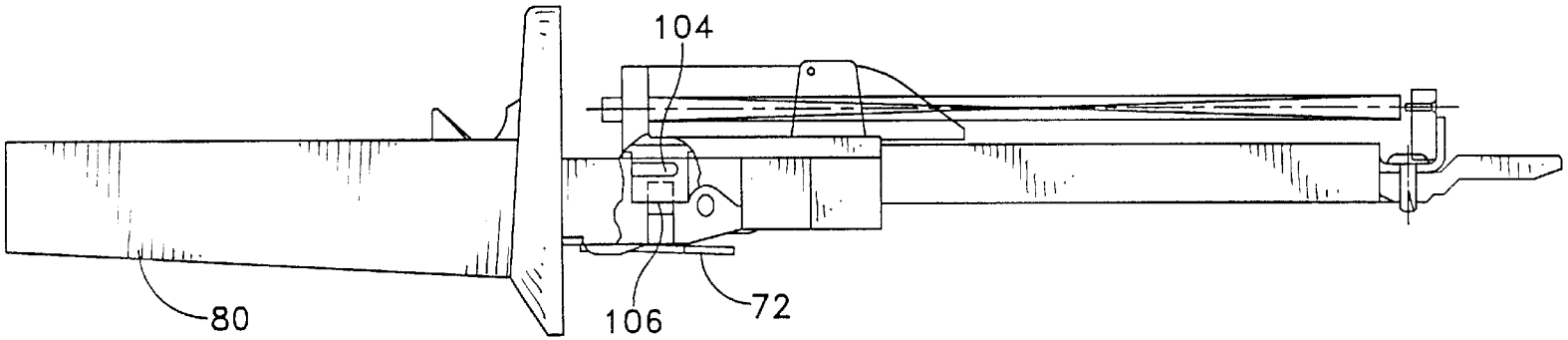
FIG. 6 is a side elevation view, partly cut away, showing the coinslide in the position shown in FIG. 5.

As shown in FIGS. 5 and 6, the absence of the stop, which may have been sheared off, bent out of the way or otherwise made inoperative, allows the slide to advance beyond the position at which the stops of the slide and the housing abut to define the end of the normal operating span. The locking mechanism comprising the spring loaded tenon aligns with the mortise therefor at just beyond the normal operating span, for example at a position beyond the normal operating span equal to the width of the frangible stop. Thus, if the stop has been removed, the tenon drops into the mortise and prevents subsequent retraction of the slide.

The invention disables a coin acceptor, which has been broken. The fact that the acceptor is broken is readily apparent because the slide is stuck at its advanced position, providing a visual indication that service is needed. The tenon and mortise arrangement is quite durable and resists the exertion of force that might be needed to retract the slide, for example by employing a lever between the housing and the end of the slide. The usefulness of such a lever can be minimize by structuring the front end of the slide without stepped edges and the like that might give purchase to a lever.

The tenon/mortise spring loaded lock as described generally resists retraction of the slide. However there is a limit to the security of any device. With sufficient force it might be possible to overcome the tenon/mortise engagement and lever the slide back out. Should this occur, the tenon is likely to re-engage the mortise when the slide is next advanced because the frangible stop no longer defines a stopping position that is short of the position at which the tenon engages in the mortise. It is impractical for the perpetrator to continue to go to the effort needed to retract the mortise for each normally low value vending operation that could be obtained in this way.

The invention is applicable to coin acceptor devices as well as to vending or access control devices that are structured as describe. The invention has been described with respect to a particular embodiment. A number of additional variations are also possible and should be apparent in view of the foregoing explanation and examples. Many of the structural aspects that are otherwise known in vanities, sinks and basins can be applied to the invention, and need not be discussed in detail. The invention is capable of application to a range of embodiments, and reference should be made to the appended claims rather than the foregoing discussion of preferred arrangements, to determine the scope of the invention in which exclusive rights are claimed.

What is claimed is:

1. An acceptor for coins or tokens, comprising:

an acceptor slide, movably mounted relative to a housing, the slide being structured to receive coins or tokens of value and to be movable toward an operating position at which operation of the acceptor is detectable, said acceptor slide having a path with an extreme inward sliding position;

a discriminator in the housing, the discriminator being associated with the acceptor slide and being operable to test for tender of said value, the discriminator permitting the acceptor slide to move toward the operating position when the predetermined complement has been tendered and otherwise to block the acceptor slide, wherein the discriminator is potentially breakable in a manner that defeats blockage of the acceptor slide by the discriminator;

a latch mechanism operable to capture the acceptor slide relative to the housing when the acceptor slide is forced along said path, beyond the extreme inward sliding position.

2. The acceptor of claim 1, wherein the latch mechanism comprises a spring loaded latch member that engages with the housing when the slide is beyond the extreme inward sliding position.

3. The acceptor of claim 2, wherein the housing defines a mortise and the latch member engages the mortise by moving laterally relative to the path, thereby capturing the slide at an advance position relative to the housing.

4. The acceptor of claim 2, wherein the housing comprises a channel that receives the slide and defines the path, and wherein the latch member is disposed substantially between an underside of the slide and an inside bottom of the channel.

5. The acceptor of claim 1, further comprising a stop provided by surfaces of the slide and the housing which abut at the extreme inward sliding position.

6. The acceptor of claim 5, wherein at least one of said surfaces which abut at the extreme inward sliding position is part of an extension that is displaced by forcing the slide beyond the extreme inward sliding position.

7. The acceptor of claim 6, wherein the extension is frangibly attached to one of the slide and the housing and is sheared off by forcing the slide beyond the extreme inward sliding position.

8. The acceptor of claim 7, wherein the latch mechanism comprises a spring loaded latch member that engages with the housing when the slide is beyond the extreme inward sliding position.

9. The acceptor of claim 8, wherein the housing defines a mortise and the latch member engages the mortise by moving laterally relative to the path, thereby capturing the slide at an advance position relative to the housing.

10. A vending control device for accepting coins or tokens for selectively enabling or disabling a vending transaction, comprising:

an acceptor slide, movably mounted relative to a housing, the slide being structured to receive coins or tokens of value and to be movable toward an operating position at which the vending transaction is enabled, said acceptor slide having a path with an extreme inward sliding position;

a discriminator in the housing, the discriminator being associated with the acceptor slide and being operable to test for tender of said value, the discriminator permitting the acceptor slide to move toward the operating position when the value has been tendered and otherwise to block the acceptor slide, wherein the discriminator is potentially breakable in a manner that defeats blockage of the acceptor slide by the discriminator and permits the acceptor slide to pass the extreme inward sliding position;

a latch mechanism operable to capture the acceptor slide relative to the housing when the acceptor slide is forced along said path, beyond the extreme inward sliding position;

whereby the slide is captured when the discriminator is broken, thereby preventing subsequent movement of the acceptor slide to the operating position.

11. The vending control device of claim 10, wherein the latch mechanism comprises a spring loaded latch member that engages with the housing when the slide is beyond the extreme inward sliding position.

12. The vending control device of claim 11, wherein the housing defines a mortise and the latch member engages the mortise by moving laterally relative to the path, thereby capturing the slide at an advance position relative to the housing.

13. The vending control device of claim 11, wherein the housing comprises a channel that receives the slide and defines the path, and wherein the latch member is disposed substantially between an underside of the slide and an inside bottom of the channel.

14. The vending control device of claim 10, further comprising a stop provided by surfaces of the slide and the housing which abut at the extreme inward sliding position.

15. The vending control device of claim 14, wherein at least one of said surfaces which abut at the extreme inward sliding position is part of an extension that is displaced by forcing the slide beyond the extreme inward sliding position.

16. The vending control device of claim 15, wherein the extension is frangibly attached to one of the slide and the housing and is sheared off by forcing the slide beyond the extreme inward sliding position.

17. The vending control device of claim 16, wherein the latch mechanism comprises a spring loaded latch member engages with the housing when the slide is beyond the extreme inward sliding position.

18. The vending control device of claim 17, wherein the housing defines a mortise and the latch member engages the mortise by moving laterally relative to the path, thereby capturing the slide at an advance position relative to the housing.

19. A vending machine, comprising:

an apparatus responsive to operation of an acceptor for providing one of a product and a service in exchange for value tendered by a customer;

an acceptor slide, movably mounted relative to a housing, the slide being structured to receive coins or tokens representing said value and to be movable toward an operating position at which the operation of the acceptor is detected, said acceptor slide having a path with an extreme inward sliding position;

a discriminator in the housing, the discriminator being associated with the acceptor slide and being operable to test for tender of said value, the discriminator permitting the acceptor slide to move toward the operating position when the value has been tendered and otherwise to block the acceptor slide, wherein the discriminator is potentially breakable in a manner that defeats blockage of the acceptor slide and permits the acceptor slide to pass the extreme inward sliding position;

a latch mechanism operable to capture the acceptor slide relative to the housing when the acceptor slide is forced along said path, beyond the extreme inward sliding position;

whereby the slide is captured when the discriminator is broken, thereby preventing subsequent operation of the acceptor.

20. The vending machine of claim 19, wherein the latch mechanism comprises a spring loaded latch member that engages with the housing when the slide is beyond the extreme inward sliding position.

21. The vending machine of claim 20, wherein the housing defines a mortise and the latch member engages the mortise by moving laterally relative to the path, thereby capturing the slide at an advance position relative to the housing.

22. The vending machine of claim 19, further comprising a stop provided by surfaces of the slide and the housing which abut at the extreme inward sliding position.

23. The vending machine of claim 22, wherein at least one of said surfaces which abut at the extreme inward sliding position is part of an extension that is displaced by forcing the slide beyond the extreme inward sliding position.

24. The vending machine of claim 23, wherein the housing comprises a channel that receives the slide and defines the path, and wherein the latch member is disposed substantially between an underside of the slide and an inside bottom of the channel.

25. The vending machine of claim 23, wherein the extension is frangibly attached to one of the slide and the housing and is sheared off by forcing the slide beyond the extreme inward sliding position.

* * * * *